United States Patent [19]

Tellman

[11] 4,261,152

[45] * Apr. 14, 1981

[54] MULTI-LAP SIDING WITH BEADED EDGE

[75] Inventor: Stephen J. Tellman, Patterson, N.Y.

[73] Assignee: Champion International Corporation, Stamford, Conn.

[ * ] Notice: The portion of the term of this patent subsequent to Feb. 19, 1997, has been disclaimed.

[21] Appl. No.: 78,551

[22] Filed: Sep. 24, 1979

[51] Int. Cl.[3] ..... E04D 3/18

[52] U.S. Cl. ..... 52/541; 52/314; 52/558

[58] Field of Search ..... 52/541, 313, 314, 557, 52/558; 144/13, 134; D25/73, 74

[56] References Cited

U.S. PATENT DOCUMENTS

| | | | |
|---|---|---|---|
| 337,664 | 3/1886 | Daugherty | 52/593 |
| 430,187 | 6/1890 | Kendall | 52/541 |
| 494,543 | 4/1893 | Betts | 52/609 |
| 517,521 | 4/1894 | Hensel | 52/593 |
| 1,908,313 | 5/1933 | Brown | 52/541 |
| 2,990,651 | 7/1961 | Chalmers | 52/316 |
| 3,812,002 | 5/1974 | Lurie | 428/163 |
| 4,188,762 | 2/1980 | Tellman | 52/541 |

*Primary Examiner*—James L. Ridgill, Jr.
*Attorney, Agent, or Firm*—Evelyn M. Sommer

[57] ABSTRACT

A multi-lap siding formed from a hardboard material is disclosed. The multi-lap siding is rectangular and has generally flat, opposed front and rear surfaces, and an upper leading edge and the lower trailing edge being configured such that the upper leading edge of one siding can cooperate and interfit with the lower trailing edge of another siding to form a continuous siding installation. The lower edge of the front surface of the siding is provided with a lower bead portion. The upper edge of the lower bead portion is defined by a first, V-shaped groove having an angled upper edge, a rounded lower edge and a rounded apex portion. The lower edge of the lower bead portion is defined by the lower edge of the siding and is also rounded. The siding is further provided with at least one central bead portion disposed intermediate the front surface of the siding. The upper edge of the central bead portion is defined by a second V-shaped groove having a configuration similar to the first V-shaped groove. The lower edge of the central bead portion is defined by a substantially vertical cut extending perpendicular to the back surface of the siding. The characteristics of the central bead portion approximate the appearance of the actual overlap between the upper leading edge of one siding and the lower trailing edge of another siding, and by this arrangement, an aesthetically pleasing appearance of a plurality of narrow overlapping panels is achieved.

11 Claims, 4 Drawing Figures

MULTI-LAP SIDING WITH BEADED EDGE

The subject invention relates to a multi-lap siding made from a hardboard material. More particularly, a hardboard siding is provided wherein each individual strip when mounted on the wall of a building produces the appearance of multiple overlapping panels or segments. The new and improved multi-lap hardboard siding of the subject invention has opposed generally planar front and rear surfaces, and is provided with an upper leading edge and a lower trailing edge. The upper leading edge of one hardboard siding is configured to cooperate with the lower trailing edge of another hardboard siding, such that when mounted onto the walls of a building, they interfit to form a continuous siding installation.

The front surface of the siding of the subject invention is machined such that the appearance of multiple overlapping plys of hardboard exist. More particularly, at least one central bead portion is machined into the front surface of the siding to produce the appearance of the lower edge of a lap. The upper edge of the central bead portion is defined by a V-shaped groove extending the width of the siding. The lower edge of the central bead portion is defined by a vertical cut extending perpendicularly to the back surface of the siding and extending to a point intermediate the thickness of the siding.

The lower edge of the front surface of the siding is further provided with a similar lower bead portion, with the upper edge thereof being defined by a V-shaped groove. The lower edge of the lower bead portion corresponds to the lower edge of the siding. In accordance with the subject invention, the upper edge of each V-shaped groove is sharply angled while the lower edge and the apex portion of each groove are rounded. In addition, the lower edges of both bead portions are rounded. By this arrangement, a pattern of light and dark shadows is produced which aid in simulating the appearance of overlapping segments.

Sidings used in the prior art consisted generally of individual strips or panels which were mounted onto a wall of a building. When aesthetic needs require panels having a width of 6 inches or less, many man hours of labor are required to install the numerous strips necessary to cover the walls of a building. More particularly, for each ten foot wall, a minimum of twenty such strips were required to complete the installation. Further, a substantial amount of material waste resulted since there is an overlap at the juncture between each individual panel. More specifically, at least one inch of overlap at the top and bottom edges of the panels are necessary in order to provide for adequate sealing.

Accordingly, it is an object of the subject invention to provide a multi-lap hardboard siding which can be installed in substantially less time than individual panels, while maintaining the appearance of individual panels.

It is a further object of the subject invention to provide a multi-lap hardboard siding which reduces the amount of wasted material resulting from the overlap of individual panels.

It is another further object of the subject invention to provide a multi-lap hardboard siding which provides adequate sealing and is easy to install.

In accordance with these and many other objects, the subject invention provides a multi-lap siding formed from a hardboard material. A hardboard is manufactured primarily of an inter-felted ligno-cellulosic fibers, consolidate under heat and pressure on a hot press to a density of not less than 31 pounds per cubic foot. The hardboard is produced in strips of approximately 12 inches in height and have a nominal thickness of approximately 7/16 of an inch.

A generally rectangular strip of hardboard material having substantially planar front and rear surfaces is machine cut to form the multi-lap hardboard siding of the subject invention. The siding is provided with an upper leading edge and a lower trailing edge. The upper leading edge is defined by a flat cut portion provided at the upper edge of the front surface of the siding. More specifically, a flat cut portion is provided which extends parallel to the rear surface for approximately 1 inch. An arcuate upper cut portion fairs outwardly from the termination of the flat cut portion and terminates at the front surface of the siding.

A substantially rectangular cut portion is disposed at the lower end of the rear surface of the strip and defines the lower trailing edge. The rectangular cut portion extends for approximately 1 inch and has a thickness substantially the same as the thickness of the upper leading edge. By this arrangement, the upper leading edge of one siding strip of the subject invention cooperates to interfit with the lower trailing edge of another siding strip to form a continuous siding installation.

The front surface is configured to give the appearance of a plurality of panels or lap sections. In the preferred embodiments, each lap section is substantially equal in height and are distributed proportionally along the front surface of the siding.

The front surface of the siding is provided with a lower bead portion disposed adjacent the bottom edge thereof. The upper edge of the lower bead portion is defined by a V-shaped groove which is spaced from the bottom edge of the front surface, and is provided with a sharply angled upper edge and a rounded lower edge. In addition, the apex portion of the V-shaped groove is also rounded. The lower edge of the lower bead is defined by the rounded lower edge of the front surface of the siding.

The front surface of the siding of the subject invention is further provided with at least one central bead portion disposed at a point intermediate the height of the siding. The upper edge of the central bead portion is defined by a V-shaped groove having a sharply angled upper edge, a rounded lower edge and a rounded apex portion. The lower edge of the central bead portion is defined by a substantially vertical cut extending perpendicularly to the back surface to a point intermediate the thickness of the siding. The lower edge of the central bead portion is also rounded. The central bead portion further includes an arcuate cut portion which extends from the terminating point of the vertical cut and terminates at the front surface of the siding. In a second embodiment of the subject invention, two central bead portions are provided proportionately distributed along the front surface of the siding.

The specific arrangement of a central and lower bead portion, each being defined by a V-shaped groove having both angled and rounded portions, functions to give the appearance of multiple laps. In addition, the generally planar front surface of the siding inhibits the trapping or collection of dirt or moisture which could warp, ruin or disfigure the siding. Further, by providing for a generally rounded apex portion for the V-shaped notch associated with the lower bead portion, the structural integrity of the lower trailing edge is maintained. More specifically, a sharply angled V-shaped groove would create a line of weakness along the lower trailing edge, and therefore, a rounded apex portion is provided such that the likelihood of the cracking or breaking of the lower trailing edge portion is substantially reduced.

Further objects and advantages of the present invention will become apparent from the following detailed description taken in conjunction with the drawings, in which.

Figure 1:
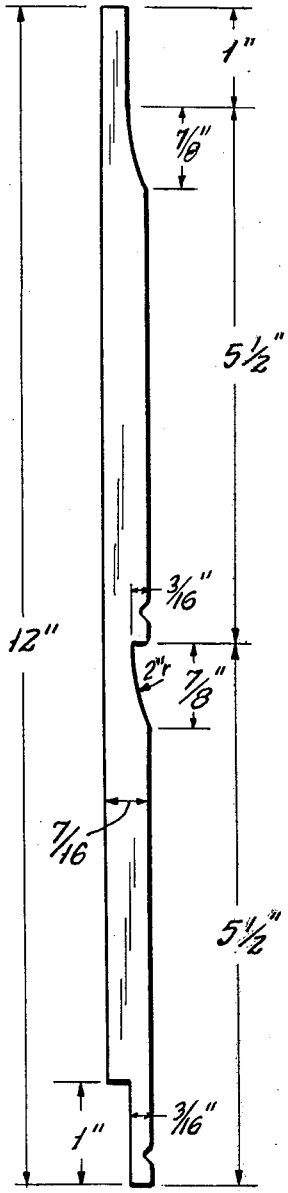
FIG. 1 is a side view of a first embodiment of the multi-lap hardboard siding of the subject invention.

Referring to FIG. 1, a first embodiment of the multi-lap hardboard siding of the subject invention is illustrated and is indicated generally by the numeral 10. The siding 10 is formed from an elongated strip of hardboard material. As specified in the American Hardboard Association's "Products Standard for Today's Hardboard", published by the U.S. Department of Commerce, National Bureau of Standards, November, 1973, Nos. PS 85-73, hardboard is formed by consolidating wood chips or fibers under heat and pressure. More particularly, through a felting or other similar process, lignocellulosic fibers are formed into a mat and subjected to heat and pressure in a hot press and consolidated to a density of at least 31 pounds per cubic foot. Other materials, known in the art, may be added to improve certain properties such as stiffness, hardness, finishing properties, resistance to abrasion and moisture, as well as to increase strength, durability and utility.

In the preferred embodiments of the subject invention, the multi-lap siding has a height of 12 inches and a nominal thickness of 7/16 of an inch. The width of the siding will vary depending upon the particular usage. The rectangular siding 10 is provided with substantially planar front and rear surfaces 20 and 22. The characteristics of the siding of the subject invention are either molded or machined into the front and rear surfaces. More particularly, a flat cut portion 24 is formed along the upper edge of the front surface 20 of the siding and extends parallel to the back surface 22. The flat cut portion 24 extends approximately 1 inch from the top of the siding and defines the upper leading edge 26 which has a thickness of approximately ¼ of an inch. An upper arcuate cut portion 28 fairs out away from the terminating point of the flat cut portion 24 and terminates at the front surface 20 of the siding 10. In the first embodiment of the subject invention, the upper arcuate cut portion 28 extends for 7/8 of an inch in the vertical direction and has a radius of 2 inches. The smooth transition between the upper arcuate cut portion 28 and the flat cut portion 24 is provided to facilitate the installation of the siding, as more fully described hereinafter.

A lower bead portion 30 is provided at the lower edge of the front surface 20 of the siding 10. The upper edge of the lower bead portion 30 is defined by a V-shaped groove 32 which is spaced approximately 5/16 of an inch from the lower edge of the siding. The V-shaped groove 32, having a depth of approximately 3/32 of an inch, has an upper edge 34 which is sharply angled. In contrast, the lower edge 36, as well as the apex portion 38 of the V-shaped groove 32, are generally rounded. In addition, the lower edge of the lower bead 30 which corresponds to the bottom edge 40 of the siding is also rounded. This specific configuration of sharp angles and rounded curves produces a pattern of reflected light which aids in producing the appearance of a multi-lap siding, as more fully described hereinafter.

Figure 2:
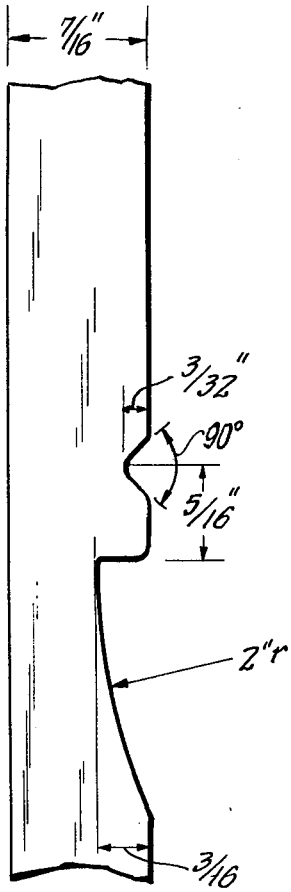
FIG. 2 is a partial enlarged side view of the central bead portion of the multi-lap hardboard siding of the subject invention.

In the first embodiment of the subject invention, a single central bead portion 50 is provided in the front surface 20 of the siding 10 and is disposed generally central to the height of the siding. As more particulary illustrated in FIG. 2, the upper edge of the central bead portion 50 is defined by a second V-shaped groove 52. V-shaped groove 52 has a sharply angled upper edge 54, a rounded lower edge 56, and a rounded apex portion 58 with the V-shaped groove being spaced 5/16 of an inch from the lower edge of the bead. The sides of the V-shaped groove 52 are disposed at a 90° angle relative to each other. The lower edge of the central bead portion 50 is defined by a substantially vertical cut 60 which extends perpendicular to the rear surface 22 for a distance of approximately 3/16 of an inch. The lower edge of the central bead portion 50 is also rounded. Both the central and lower bead portions 50 and 30 are provided with substantially similar characteristics such that the appearance of the multi-lap feature is enhanced. A second arcuate cut 62 is provided which extends from the termination of the vertical cut 60 and terminates at the front surface 20 of the siding. The second arcuate cut 62 extends for a height of approximately 7/8 of an inch and has a 2 inch radius similar to the first arcuate cut 28 again to facilitate the appearance of the multiple laps. In the preferred embodiment, the central bead portion 50 is positioned 5 ½ inches from the bottom edge 40, and 5 ½ inches from the upper edge of the first arcuate cut 28. When the siding is installed, the flat cut portion 24 is overlapped and covered by the siding above, and thus the central bead portion 50 will appear to be located at the exact center of the siding.

In accordance with the subject invention, a generally rectangular cut portion 70 is provided at the lower edge of the rear surface 22 of the siding. The rectangular cut portion 70 extends for approximately 1 inch and has a depth of ¼ of an inch. The depth of the cut portion 70 is substantially equal to the width of the upper leading edge 26 of the siding 10 such that the upper leading edge 26 of one siding of the subject invention may interfit and cooperate with the cut portion 70 of another multi-lap siding to form a continuous siding installation.

Figure 3:
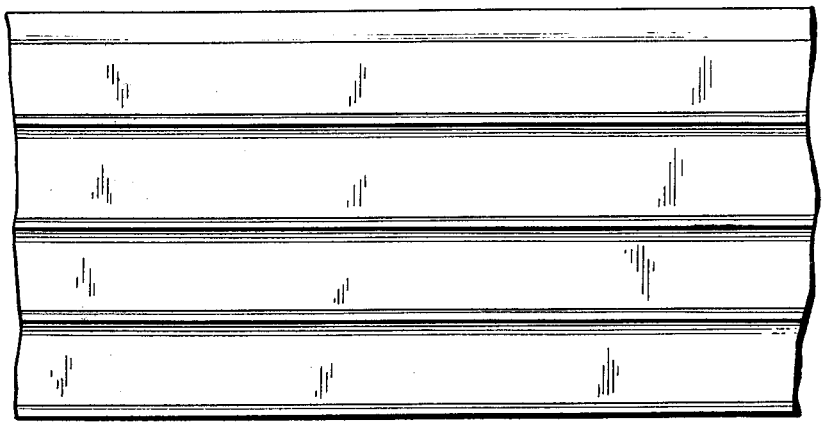
FIG. 3 is an elevational view of a plurality of strips of the multi-lap hardboard siding of the subject invention as they would appear installed.

A plurality of sidings 10 may be mounted or installed on the wall of a building or other edifice. During installation, the back surface 22 of a siding is attached by a suitable means to the wall of the building to be covered. A second siding 10 is then mounted above the first siding such that the lower trailing edge thereof overlaps the upper leading edge 26 of the first siding. More particularly, the upper leading edge 26 of the lower siding which has a thickness of approximately ¼ of an inch and a height of 1 inch, cooperates and interfits with the rectangular cut portion 70 having similar complementary dimensions. As illustrated in FIG. 3, a continuous installation is achieved by interfitting and mounting the sidings.

It is preferred that there be approximately 1 inch of overlap between each individual siding such that adequate sealing for moisture and other elements may be provided. By providing for the smooth transition between the upper arcuate cut portion 28 and the flat cut portion 24, the installation of the sidings is facilitated. More specifically, during installation of the siding strips, a lower panel may be inadvertently installed at an angle to the horizontal. This problem is usually corrected by properly aligning the next strip of siding in the horizontal direction. If a sharp deviation existed between the flat cut portion 24 and the upper arcuate cut portion 28, an unsightly line at the juncture between the panels would be highly noticeable. In contrast, due to the smooth transition between the sections, if the upper siding is installed with a slight angle relative to the siding below, no sharp line would be produced and the deviation will be substantially unnoticeable.

As illustrated in FIG. 3, the two overlapping sidings of the subject invention give the appearance of four individual laps of siding being mounted in an overlapping relationship. This appearance is created by the combination of the machined surfaces and the relative angularity or rounding of the machined edges, as well as the actual overlap between the individual panels. More particularly, the relatively sharp angle provided at the upper edge of each V-shaped groove 32, 52 functions to create a hard sharp line or shadow when sunlight is reflected off the siding 10. In contrast, the curved lower edges of the V-shaped grooves 32, 52 function to provide a soft shadow line, thereby enhancing the appearance of the beads of the siding. The bead portions 30, 50 of the sidings are further enhanced by their rounded lower edges. An appearance of continuity is achieved by conforming the appearance of the central bead portion to the appearance of the actual overlap between the sidings. The appearance of the actual overlap between the sidings is a result of the sharp vertical lower edge 40 of the upper siding which abuts the upper edge of the upper arcuate cut portion 28 of the siding which it overlaps. A similar appearance is achieved at the central bead portion by providing for a substantially vertical cut 60 which extends to a depth of approximately 3/16 of an inch. In addition, the second arcuate cut portion extends from the termination of the vertical cut 60 duplicating the appearance of the upper arcuate cut portion 28. The dimensions of the upper and lower bead portions, as well as the arcuate cut portions are substantially similar and by this arrangement, both the actual overlap and the apparent overlapping produce equivalent visual effects. Thus, an entire wall may be covered with the siding of the subject invention to produce a uniform continuous appearance.

An additional advantage is achieved by rounding the apex portion of the V-shaped grooves, and more particularly, the lower V-shaped groove 32. Since the siding 10 is relatively thin at the lower trailing edge thereof, it is susceptible to breakage. If the V-shaped groove were provided with an angled apex portion, a point of weakness would be created which would increase the changes of the lower trailing edge cracking or breaking. In contrast, by providing for a rounded apex portion 36 of the lower V-shaped groove 32, the structural integrity of the lower trailing edge may be maintained and the likelihood of breakage is substantially reduced.

Figure 4:
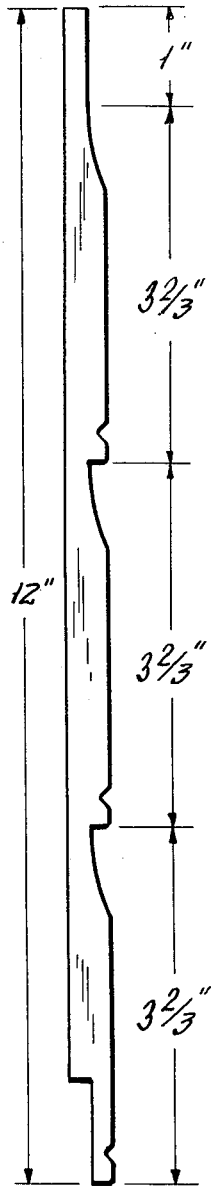
FIG. 4 is a side view of a second embodiment of the multi-lap hardboard siding of the subject invention.

A second embodiment of the subject invention is illustrated in FIG. 4. In this embodiment, a second central bead portion is provided with the two central bead portions being proportionally spaced along the front surface of the siding. As in the first embodiment, the siding is provided with opposed generally planar front and rear surfaces 20' and 22'. A flat cut portion 24' provided at the upper edge of the siding and extending parallel to the back surface of the siding for approximately 1 inch, defines the upper leading edge 26'. An upper arcuate cut portion 28' is provided which fairs outwardly from the lower termination point of the upper cut portion 24' and terminates at the front surface 20' of the siding.

The lower trailing edge in the second embodiment is substantially similar to the lower trailing edge of the first embodiment. More specifically, a lower bead portion 30' is provided which is defined by a V-shaped groove 32' and the lower edge 40' of the siding. As in the first embodiment, the upper edge of the V-shaped groove 32' is sharply angled while the lower edge and apex portion are rounded. In addition, the lower edge of the bead portion 30' is also rounded. Further, a generally rectangular cut portion 70' is provided at the rear surface and extends approximately 1 inch in height. Installation of the siding may therefore be accomplished in the same manner as provided in the first embodiment.

Referring to FIG. 3, the second embodiment of the subject siding provides for upper and lower central bead portions 80', 90', proportionally, spaced along the front surface thereof. Each central bead portion is substantially similar to the central bead portion of the first embodiment. More specifically, the upper edge of the upper central bead portion 80' is defined by a V-shaped groove 82' having an angled upper edge, a rounded lower edge, and a rounded apex portion. The lower edge of the central bead portion 80' is defined by a substantially vertical cut 82' extending perpendicular to the back surface 22' for a distance of approximately 3/16 of an inch. An arcuate cut portion 84' is provided which extends from the termination of the vertical cut 82' and terminates at the front surface 20' of the siding. The upper edge of the lower bead portion 90' is similarly defined by a V-shaped groove 92' having an angled upper edge, a rounded lower edge, and a rounded apex portion. The lower edge of the lower central bead portion 90' is defined by a vertical cut 94' which extends perpendicular to the back surface 22' for a distance of approximately 3/16 of an inch. The lower edge of the bead portion 90' is also rounded. An arcuate cut portion 96' is provided which extends from the termination of the vertical cut 90' and terminates at the front surface 20' of the siding.

In the embodiment of FIG. 3, each lap section is approximately 3 $\frac{1}{3}$ inches in height. By this arrangement, in combination with the actual overlap of individual sidings, a continuous appearance of narrow overlapping panels is produced. More particularly, and similar to the first embodiment, the central bead portions create an appearance substantially similar to the appearance of the actual overlap between the sidings to provide the appearance of continuous overlapping narrow panels. While double and triple lap configurations are illustrated, it is intended that the scope of the subject invention include a hardboard siding provided with any number of similarly configured central bead portions.

Accordingly, there is provided a new and improved multi-lap hardboard siding which gives the appearance of multiple overlapping panels. The hardboard siding is provided with opposed front and rear substantially planar surfaces having an upper leading edge and a lower trailing edge which cooperate to interfit to form a continuous siding installation. The front surface of each siding is further provided with a lower bead portion with the upper edge thereof defined by a V-shaped groove spaced from the lower edge of the siding and with the lower edge of the bead portion defined by the lower edge of the siding. Further, at least one central bead portion is provided wherein the upper edge of the central bead is defined by a similarly configured V-shaped groove and the lower edge is defined by a substantially vertical cut. Each central bead portion is configured to produce an appearance equivalent to the appearance of the actual overlap between the upper leading edge of one siding and the lower trailing edge of another similar siding.

Although the multi-lap hardboard siding has been described by reference to a preferred embodiment, it is apparent that other modifications could be devised by those skilled in the art that would fall within the scope and spirit of the present invention as defined by the appended claims.

What is claimed is:

1. A multi-lap hardboard siding formed from a single, elongated strip of hardboard material having front and back, substantially planar, opposed surfaces comprising:

an upper leading edge and a lower trailing edge, respectively disposed at opposite ends of the strip;

a flat cut portion extending from the upper end of said strip, parallel to the back surface and terminating at a point intermediate the height of the strip and defining the upper leading edge of the siding;

an upper arcuate cut portion extending from the terminating point of said flat cut portion and bead portion further including an arcuate cut portion extending from the terminating point of said vertical cut and terminating at the front surface of said strip; and said back surface of said strip including a substantially rectangular cut portion disposed at the lower edge of the strip and defining the lower trailing edge, with the thickness of said rectangular cut portion being substantially the same as the thickness of the strip between said back surface and said flat cut portion at the upper leading edge thereof, and with the height of said rectangular cut portion being substantially the same as the height of said flat cut portion such that the upper leading edge of one strip of hardboard siding cooperates with the lower trailing edge of another strip of hardboard siding to form a continuous siding installation.

2. A multi-lap hardboard siding as recited in claim 1 wherein said central bead portion is spaced equally distant from the bottom edge of said siding and from the top edge of said upper arcuate cut portion.

3. A multi-lap hardboard siding as recited in claim 1 wherein said flat cut portion extends for approximately 1 inch from the top edge of the siding.

4. A multi-lap hardboard siding as recited in claim 1 wherein said arcuate cut portions have a 2 inch radius.

5. A multi-lap hardboard siding as recited in claim 1 wherein each said V-shaped groove of said bead portions is spaced 5/16 of an inch from the lower edge of the respective bead portions.

6. A multi-lap hardboard siding as recited in claim 1 wherein each said arcuate cut penetrates said strip to approximately the same thickness level.

7. A multi-lap hardboard siding as recited in claim 1 further including another central bead portion formed in the front surface of said siding at a point intermediate the height thereof, with the upper edge of said another central bead portion being defined by a V-shaped groove having an angled upper edge, a rounded lower edge, and a rounded apex portion, with the lower edge of said another central bead being defined by a substantially vertical cut extending perpendicularly to the back surface to a point intermediate the thickness of the strip, said lower edge of said bead being rounded, said another central bead portion further including an arcuate cut portion extending from the terminating point of said vertical cut and terminating at the front surface of said strip.

8. A multi-lap hardboard siding as recited in claim 7 wherein said one central bead portion and said another central bead portion are proportionally spaced along the front surface of said siding.

9. A multi-lap hardboard siding formed from a single, elongated strip of hardboard material having front and back substantially planar, opposed surfaces comprising:

an upper leading edge and a lower trailing edge, respectively disposed at opposite ends of the strip;

a flat cut portion extending from the upper end of said strip, parallel to the back surface and terminating at a point intermediate the height of the strip and defining the upper leading edge of the siding;

an upper arcuate cut portion extending from the terminating point of said flat cut portion and terminating at the front surface of said strip, and wherein a smooth transition is provided between the lower edge of said flat cut portion and the upper edge of said upper arcuate cut portion to facilitate the installation of said siding;

a lower bead portion disposed at the bottom edge of said front surface, the upper edge of said lower bead portion being defined by a V-shaped groove spaced from the bottom edge of said front surface, said V-shaped groove having an angled upper edge, a rounded lower edge and a rounded apex portion, with the lower edge of said lower bead being defined by the rounded lower edge of the front surface of said siding;

an upper central bead portion formed in the front surface of said siding at a point intermediate the height thereof, with the upper edge of said upper central bead portion being defined by a V-shaped groove having an angled upper edge, a rounded lower edge and a rounded apex portion, with the lower edge of said upper central bead portion being defined by a substantially vertical cut extending perpendicularly to said back surface to a point intermediate the thickness of the strip, said lower edge of said upper central bead portion being rounded, said upper central bead portion further including an arcuate cut portion extending from the terminating point of said vertical cut and terminating at the front surface of said strip;

a lower central bead portion formed in the front surface of said siding at a point intermediate said upper central bead portion and said lower bead portion, with the upper edge of said lower central bead portion being defined by a V-shaped groove having an angled upper edge, a rounded lower edge, and a rounded apex portion, with the lower edge of said lower central bead portion being defined by a substantially vertical cut extending perpendicularly to said back surface to a point intermediate the thickness of the strip, said lower edge of said lower central bead portion being rounded, said lower central bead portion further including an arcuate cut portion extending from the termination point of said vertical cut and terminating at the front surface of said strip; and said back surface of said strip including a substantially rectangular cut portion disposed at the lower edge of the strip and defining the lower trailing edge, with the thickness of said rectangular cut portion being substantially the same as the thickness of the strip between said back surface and said flat cut portion at the upper leading edge thereof, and with the height of said rectangular cut portion being substantially the same as the height of said flat cut portion such that the upper leading edge of one strip of hardboard siding cooperates with the lower trailing edge of another strip of hardboard siding to form a continuous siding installation.

10. A multi-lap hardboard siding as recited in claim 9 wherein the distance between the bottom edge of said siding and said lower central bead portion, and the distance between said lower central bead portion and upper central bead portion, and the distance between the upper central bead portion and the top edge of said upper arcuate cut portion are all equal.

11. A multi-lap hardboard siding as recited in claim 9 wherein said flat cut portion extends for approximately 1 inch from the top edge of the siding.

* * * * *

UNITED STATES PATENT AND TRADEMARK OFFICE

CERTIFICATE OF CORRECTION

PATENT NO. : 4,261,152

DATED : April 14, 1981

INVENTOR(S) : Stephen J. Tellman

It is certified that error appears in the above—identified patent and that said Letters Patent is hereby corrected as shown below:

In Column 6, line 49, delete "3 1/3 inches" and insert in lieu thereof -- 3 2/3 inches --.

In Column 7, line 30, Claim 1, should read as shown below:

--1. (Amended) A multi-lap hardboard siding formed from a single, elongated strip of hardboard material having front and back, substantially planar, opposed surfaces comprising:

an upper leading edge and a lower trailing edge, respectively disposed at opposite ends of the strip;

a flat cut portion extending from the upper end of said strip, parallel to the back surface and terminating at a point intermediate the height of the strip and defining the upper leading edge of the siding;

an upper arcuate cut portion extending from the terminating point of said flat cut portion and

UNITED STATES PATENT AND TRADEMARK OFFICE

CERTIFICATE OF CORRECTION

PATENT NO. : 4,261,152

DATED : April 14, 1981

INVENTOR(S) : Stephen J. Tellman

It is certified that error appears in the above--identified patent and that said Letters Patent is hereby corrected as shown below:

terminating at the front surface of said strip and wherein a smooth transition is provided between the lower edge of said flat cut portion and the upper edge of said upper arcuate cut portion to facilitate the installation of said siding;

a lower bead portion disposed at the bottom edge of said front surface, the upper edge of said lower bead portion being defined by a V-shaped groove spaced from the bottom edge of said front surface, said V-shaped groove having an angled upper edge, a rounded lower edge and a rounded apex portion, with the lower edge of said lower bead being defined by the rounded lower edge of the front surface of said siding;

at least one central bead portion formed in the front surface of said siding at a point intermediate the height thereof, with the upper edge of said central bead portion being defined by a V-shaped groove

UNITED STATES PATENT AND TRADEMARK OFFICE

CERTIFICATE OF CORRECTION

PATENT NO. : 4,261,152

DATED : April 14, 1981

INVENTOR(S) : Stephen J. Tellman

It is certified that error appears in the above—identified patent and that said Letters Patent is hereby corrected as shown below:

having an angled upper edge, a rounded lower edge, and a rounded apex portion, with the lower edge of said central bead portion being defined by a substantially vertical cut extending perpendicularly to said back surface to a point intermediate the thickness of the strip, said lower edge of said central bead portion being rounded, said central bead portion further including an arcuate cut portion extending from the terminating point of said vertical cut and terminating at the front surface of said strip; and said back surface of said strip including a substantially rectangular cut portion disposed at the lower edge of the strip and defining the lower trailing edge, with the thickness of said rectangular cut portion being substantially the same as the thickness of the strip between said back surface and said flat cut portion at the upper leading

UNITED STATES PATENT AND TRADEMARK OFFICE

CERTIFICATE OF CORRECTION

PATENT NO. : 4,261,152

DATED : April 14, 1981

INVENTOR(S) : Stephen J. Tellman

It is certified that error appears in the above—identified patent and that said Letters Patent is hereby corrected as shown below:

edge thereof, and with the height of said rectangular cut portion being substantially the same as the height of said flat cut portion such that the upper leading edge of one strip of hardboard siding cooperates with the lower trailing edge of another strip of hardboard siding to form a continuous siding installation.--

Signed and Sealed this

*First* Day of *September 1981*

[SEAL]

*Attest:*

GERALD J. MOSSINGHOFF

*Attesting Officer* *Commissioner of Patents and Trademarks*